United States Patent [19]

Ang

[11] Patent Number: 4,624,389

[45] Date of Patent: Nov. 25, 1986

[54] METHOD OF PERSONAL SELF-DEFENSE

[76] Inventor: Khoen P. Ang, 6541 Edwood, Cincinnati, Ohio 45224

[21] Appl. No.: 227,387

[22] Filed: Jan. 22, 1981

[51] Int. Cl.[4] ..... B05B 11/04

[52] U.S. Cl. ..... 222/1; 222/78

[58] Field of Search ..... 42/1 G; 222/78, 79, 222/1

[56] References Cited

U.S. PATENT DOCUMENTS

| | | | |
|---|---|---|---|
| 927,040 | 7/1909 | Hamilton | 222/79 |
| 1,994,294 | 3/1935 | Williams | 42/2 |
| 2,249,608 | 7/1941 | Greene | 222/79 |
| 2,987,439 | 6/1961 | Wittlinger | 167/59 |
| 3,109,253 | 11/1963 | Eig | 42/1 |
| 3,241,259 | 3/1966 | McBride | 42/1 |
| 3,298,125 | 1/1967 | Adrian | 42/1 |
| 3,353,749 | 11/1967 | Lahaug | 239/154 |
| 3,443,333 | 5/1969 | Manatos | 42/1 |
| 3,568,674 | 3/1971 | Palmer | 128/215 |
| 3,602,399 | 8/1971 | Litman | 222/153 |
| 3,640,274 | 2/1972 | Costello | 128/173 |
| 3,744,717 | 7/1973 | Kozub | 239/1 |
| 4,034,497 | 7/1977 | Yanda | 42/1 |
| 4,058,921 | 11/1977 | Mason | 42/1 |
| 4,175,704 | 11/1979 | Cohen | 239/320 |

OTHER PUBLICATIONS

*The Condensed Chemical Dictionary*: Gessner G. Hawley, Van Nostrand Reinhold Co., 1981, 10th ed. p. 651.

*Primary Examiner*—David A. Scherbel

*Attorney, Agent, or Firm*—Frost & Jacobs

[57] ABSTRACT

A method of personal self-defense against a human assailant where an aerosol stream of finely divided droplets of a non-toxic liquid substance comprising 0.5%-1.0% menthol in a carrier liquid of water and alcohol is sprayed in the direction of an assailant's face. The mixture causes immediate tearing and stinging of the eyes when the substance comes in contact with the eyes or the area immediately surrounding the eyes. The mixture is dispensed in a directional aerosol stream which extends for several feet by a hand-held non-pressurized manually operable nebulizer, aerosol or atomizer dispenser, particularly of the squeeze-bottle type. The method is particularly effective in preventing personal attacks.

10 Claims, No Drawings

METHOD OF PERSONAL SELF-DEFENSE

SUMMARY OF THE INVENTION

Various methods have been suggested for protecting an individual against a human assailant by causing the assailant to break off the attack. Methods involving weapons such as guns, knives and the like are not suggested since they require a considerable degree of skill for effective use, and may be turned against the victim by the assailant.

A common method of self-defense involves the use of a hand carried pressurized dispenser containing a quantity of CS tear gas or the like. The dispenser opening can be pointed in the direction of the assailant and operated to cause a cloud of the tear gas to envelop the assailant's head, causing immediate pain and the like. While such devices are widely available, they have not proven entirely satisfactory under all conditions. For example, the pressurized propellant contained in the dispenser may leak off, making the dispenser worthless when it is most needed. In addition, elevated temperatures or a sudden shock to the dispenser may cause it to explode with possible harmful results. The nature of the CS tear gas or the like contained within the dispenser has also been found unsuitable for use by small children, or in situations where a sudden wind shift may cause the gas to be blown back into the victims face. In an extreme case, the tear gas may cause permanent damage to the assailant or innocent bystanders.

The present invention is directed to a method of personal self-defense which is safe to use by persons of any age, yet provides an effective detterent to a would-be assailant. In a preferred embodiment, the self-defense method involves spraying in the direction of the assailant an aerosol stream of finely divided droplets of a non-toxic liquid substance capable of disabling the assailant by causing almost immediate tearing and stinging of the eyes for at least sixty seconds without permanent harmful effect when the liquid substance comes in contact with the eyes or the sensitive areas immediately surrounding the eyes. The substance is selected from the group of thymol derivates particularly those comprising essential oils such as peppermint oil, mint oil, peppermit camphor, menthol and the like. The substance may be mixed with a carrier liquid such as water and/or alcohol, so that the resulting liquid includes about 0.5%–1% menthol by weight.

The mixture is included in a hand-held manually operable non-presssurized nebulizer, atomizer or aerosol dispenser having a dispensing orifice for creating a directional aerosol stream of the substance which extends for several feet, and which can be aimed toward the assailant's eye area. The dispenser container is constructed of a flexible material holding the substance, and is operated by squeezing opposing surfaces of the container. The dispenser container will be constructed of a plastic or other flexible material which can be easily operated by a child. In a preferred embodiment the dispenser will have a squeezable portion in the shape of a ball formed to fit the hand to insure positive squeezing. Furthermore, the dispenser can be operated in substantially any position.

As will become apparent from the detailed description which follows, the debilitating substance contained within the dispensing container is of natural origin, and substantially non-toxic. Consequently, the device may be utilized by children without danger of poisoning or accidental or inadvertent operation which could cause permanent harm.

Further features of the invention will become apparent from the detailed description which follows.

DETAILED DESCRIPTION

As noted hereinabove, the present invention is directed to a method of personal self-defense against a human assailant to cause the assailant to break off an attack. In a preferred embodiment, the method is carried out by spraying in the direction of the assailant's face an aerosol stream of finely divided droplets of a non-toxic liquid substance capable of disabling the assailant without permanent harmful effect for a period of time sufficient to permit the victim to escape. In a preferred embodiment, the debilitating substance comprises derivatives of thymol, particularly those comprising essential oils such as peppermint oil, mint oil, peppermint camphor, menthol and the like. It has been found that menthol, in particular, produces excellent results in the method of the present invention.

The debilitating substance may be used by itself, or may be utilized in connection with a suitable liquid carrier such as alcohol or water. A mixture comprising 0.5%–1.0% menthol, with the remainder equal parts of alcohol and water has been found to produce the desired debilitating result when sprayed into the eyes of the assailant, while avoiding permanent harmful effects. Since menthol is more soluable in alcohol than water, alcohol comprises a preferred carrier liquid, and also serves to itself enhance irritation of the eyes upon contact. In any event, it will be understood that the mixture described is non-toxic, and therefore safe for use by children.

In order to provide optimum results in the present method, the substance or mixture is sprayed in the direction of the assailant's face in an aerosol stream of finely divided droplets. It has been found that this method decreases the chance that the debilitating substance will be carried back into the face of the victim. In addition, since the stream consists of liquid particles, they can be more carefully aimed toward the assailant, thereby avoiding unintended contact with innocent bystanders.

The directional aerosol stream may be produced by a conventional hand-held manually operable non-pressurized nebulizer, aerosol or atomizer dispenser, the construction of which is well-known to those in the art. It is preferred that a squeeze-type bottle constructed of a resilient substance be used which is capable of containing several ounces of the debilitating substance or mixture. The nebulizer, aerosol or atomizer dispenser may include a container having resilient opposing surfaces which may be squeezed to dispense a stream of finely divided droplets extending for approximately two feet. Alternatively, the dispenser may be formed in the shape of a ball to better fit the hand and thus provide positive squeezing. The stream may diverge slightly to include the area covered by the assailant's head in a relatively dense mist to insure contact with the eyes. In general, the dispenser will be operable in any position, and will immediately dispense the aerosol stream when squeezed. Consequently, a person may carry the squeezed bottle concealed in one hand, or hidden under a pillow, for example, for immediate use upon attack. The squeeze container will be provided with a sufficient quantity of the substance or mixture to permit several spray attempts, in the event the assailant's eyes are missed on the first attempt. It will be further understood that the particular debilitating substance described hereinabove will also provide stinging or tearing of the eyes when it comes in contact with the area immediately surrounding the eyes. Consequently, direct contact with the eyes is not necessary. In addition, the concentration of the debilitating substance is such so as to limit possible damage to the eyes. However, the effect will last for a sufficient period of time, at least sixty seconds, to permit the victim to escape before the substance is washed by tears from the assailant's eyes.

It will be understood that various changes in the details, materials, steps and arrangements of parts, which have been herein described in order to explain the nature of the invention, may be made by those skilled in the art within the principle and scope of the invention as expressed in the appended claims. For example, it will be understood that even if only one eye is affected by the spray, the tearing and stinging caused will cause the assailant to close both eyes for a period of time permitting the victim to escape. It will be further understood that the materials used in the method of the present invention are inexpensive so that a squeeze bottle containing the debilitating substance or mixture may be left in several locations for immediate use; for example in a pocket, or purse or under a pillow. As used herein, nebulizer, aerosol and atomizer dispensers are used synonymously to define the type of dispenser apparatus described.

The embodiments of the invention in which an exclusive property or privilege is claimed are as follows:

1. A method of personal self-defense against a human assailant comprising spraying in the direction of the assailant's face an aerosol stream of finely divided droplets of a non-toxic liquid substance capable of disabling the assailant by causing immediate tearing and stinging of the eyes without permanent harmful effect for a period of time sufficient to permit the victim to escape when the substance comes into contact with the eyes or the area immediately surrounding the eyes, wherein said substance comprises a thymol derivative selected from the class consisting of peppermint oil, mint oil, peppermint camphor, and menthol.

2. The method according to claim 1 wherein said aerosol is produced by a hand-held non-pressurized manually operable nebulizer having means for creating a directional aerosol stream of said substance extending for several feet.

3. The method according to claim 2 wherein said nebulizer includes a container constructed of a flexible material and holding said substance, said nebulizer being operated to produce said aerosol by squeezing said container.

4. The method according to claim 3 wherein said substance is mixed with a carrier liquid.

5. The method according to claim 4 wherein said substance comprises menthol.

6. The method according to claim 5 wherein said substance and carrier liquid mixture includes about 0.5%-1.0% menthol by weight.

7. The method according to claim 6 wherein said carrier liquid comprises water.

8. The method according to claim 7 wherein said carrier liquid includes alcohol.

9. The method according to claim 8 wherein said water and alcohol are provided in approximately equal amounts.

10. The method according to claim 9 wherein said nebulizer may be operated in any position to produce said aerosol.

* * * * *